US005367991A

United States Patent [19]

Asai et al.

[11] Patent Number: 5,367,991

[45] Date of Patent: Nov. 29, 1994

[54] VALVE OPERATING SYSTEM OF ENGINE

[75] Inventors: Akira Asai; Masami Nishida; Masaki Fukuma, all of Hiroshima, Japan

[73] Assignee: Mazda Motor Corporation, Hiroshima, Japan

[21] Appl. No.: 210,484

[22] Filed: Mar. 21, 1994

[30] Foreign Application Priority Data

Mar. 23, 1993 [JP] Japan ..... 5-064176
Mar. 23, 1993 [JP] Japan ..... 5-064177

[51] Int. Cl.[5] ..... F01L 1/34

[52] U.S. Cl. ..... 123/90.16; 123/90.17; 123/90.18; 123/90.6

[58] Field of Search ..... 123/90.15, 90.16, 90.17, 123/90.18, 90.6

[56] References Cited

U.S. PATENT DOCUMENTS 3,730,150 5/1973 Cobner, Jr. ..... 123/90.18
4,182,289 1/1980 Nakajima et al. ..... 123/90.18
4,352,344 10/1982 Aoyama et al. ..... 123/90.18
4,850,311 7/1989 Sohn ..... 123/90.18
5,080,055 1/1992 Komatsu et al. ..... 123/90.18

FOREIGN PATENT DOCUMENTS 55-137306 10/1980 Japan .
58-038602 8/1983 Japan .

*Primary Examiner*—E. Rollins Cross
*Assistant Examiner*—Weilun Lo
*Attorney, Agent, or Firm*—Keck, Mahin & Cate

[57] ABSTRACT

A valve operating system of an engine opens and closes a valve by a swing cam being swung by rotation of an operating cam. The operating cam has a cam surface and is rotated by the engine, and the swing cam has a cam surface in sliding contact with the valve and a cam follower in sliding contact with the cam surface of the operating cam. The cam surface of the operating cam and the cam surface of the swing cam are formed so that an acceleration component of the swing cam is larger than that of the operating cam in a positive region of a valve lift acceleration defined as a sum of the acceleration component of the operating cam and the acceleration component of the swing cam.

9 Claims, 8 Drawing Sheets

VALVE OPERATING SYSTEM OF ENGINE

BACKGROUND OF THE INVENTION

1. Field of the Invention

The present invention relates to a valve operating system of an internal combustion engine, and in particular to a valve operating system including operating cams and swing cams which cooperate open and close valves.

2. Description of the Related Art

Various types of internal combustion engine valve operating systems have been proposed. The valve operating system of an engine is generally provided with driving or operating cams and rocker arms which are arranged so that the valves of the engine are opened and closed by the operating cams driving the rocker arms. There is known another type of engine valve operating system which includes operating cams and swing cams adapted so that the valves of the engine are opened and closed by the operating cams directly or through swing levers swing the swing cams, as shown in, for example, Japanese Patent Laid-Open No. 55-137306.

In the valve operating system having the operating cams and the swing cams, the location of the cam follower of the swing cam at the time of maximum valve lift becomes increasingly distant from the rotating center of the operating cam as the swing angle of the swing cam becomes larger. The cam nose of the operating cam therefore needs to be large so as to follow the swing motion of the swing cam and, as a result, the valve operating system of the engine becomes large. This is one of the problems of the conventional engine valve operating system.

Therefore, a need has been felt for an engine valve operating system of relatively small size especially for use in automobile engines.

On the other hand, there is known an engine valve timing control system which includes operating cams and swing cams. Japanese Patent Publication No. 58-38602 discloses a valve timing control system of this type wherein both the operating cams and the swing cams are tapered and the valve timing is varied by moving the operating and swing cams relative to each other in the axial direction.

It is known that the volumetric efficiency of an engine can be improved and a higher engine output can be obtained by increasing the positive acceleration of the valve lift. This is because the integrated crank angle of the valve lift, namely the time period area of valve opening, becomes larger for the same opening angle and the same valve lift when the positive acceleration of the valve lift is increased.

In the above-mentioned engine valve timing control system, the valve lift acceleration is the sum of the acceleration component generated by the operating cam and the acceleration component generated by the swing cam. Being the sum of the acceleration of the operating and swing cams, the valve lift acceleration is easily varied by changes in the valve timing. If the valve lift acceleration becomes smaller than that before the valve timing was changed, the time period area of the valve opening was decreased. As a result, the engine output is decreased as the time period is decreased.

SUMMARY OF THE INVENTION

It is therefore an object of the present invention to provide a valve operating system of an engine whose size is reduced by making the swing angle of swing cams as small as possible.

It is another object of the present invention to provide a valve operating system of an engine which effectively prevents a change in valve timing from lowering engine output by preventing a change in valve timing from changing the valve lift acceleration.

These and other objects are achieved according to one aspect of the present invention by providing a valve operating system of an engine for opening and closing a valve, said system comprising, an operating cam having a cam surface, said operating cam being rotated by the engine and a swing cam having a cam surface in sliding contact with the valve and a cam follower in sliding contact with the cam surface of the operating cam, said valve being opened and closed by the swing cam being swung by rotation of the operating cam, said cam surface of the operating cam and said cam surface of the swing cam being formed so that an acceleration component of the swing cam is lager than that of the operating cam in a positive region of a valve lift acceleration defined as a sum of the acceleration component of the operating cam and the acceleration component of the swing cam.

In a preferred embodiment of the present invention, said cam surface of the operating cam and said cam surface of the swing cam are formed so that an acceleration component of the operating cam is lager than that of the swing cam in a negative region of a valve lift acceleration.

According to another aspect of the present invention, a valve operating system of an engine for opening and closing a valve, said system comprises, an operating cam having a cam surface, said operating cam being rotated by the engine, a swing cam having a cam surface in sliding contact with the valve and a cam follower in sliding contact with the cam surface of the operating cam, said valve being opened and closed by the swing cam being swung by rotation of the operating cam, and means for controlling valve timing by changing a positional relationship between the operating cam and the swing cam in an axial direction, said cam surface of the operating cam and said cam surface of the swing cam being formed so that a valve lift acceleration defined as a sum of an acceleration component of the operating cam and an acceleration component of the swing cam is not substantially changed between before and after a change in valve timing.

In a preferred embodiment of the present invention, a positive acceleration component of the cam surface of the swing cam and a positive acceleration component of the cam surface of the operating cam do not overlap at the time of a valve lift operation.

In still another preferred embodiment of the present invention, said cam surface of the operating cam and said cam surface of the swing cam are formed so that the positive acceleration component of the operating cam is advanced much more than the positive acceleration component of the swing cam.

The above and other objects and features of the present invention will be apparent from the following description made with reference to the accompanying drawings relating to preferred embodiments of the present invention.

DETAILED DESCRIPTION OF THE PREFERRED EMBODIMENTS

The present invention will now be explained with reference to preferred embodiments and the drawings.

Before explaining the first embodiment of the present invention, the considerations which inventors took into account will be explained with reference to FIGS. 1 and 2, The engine valve operating system shown in FIGS. 1 and 2 was studied to determine how valve lift acceleration characteristics affect the swing angle of a swing cam.

Figure 1:
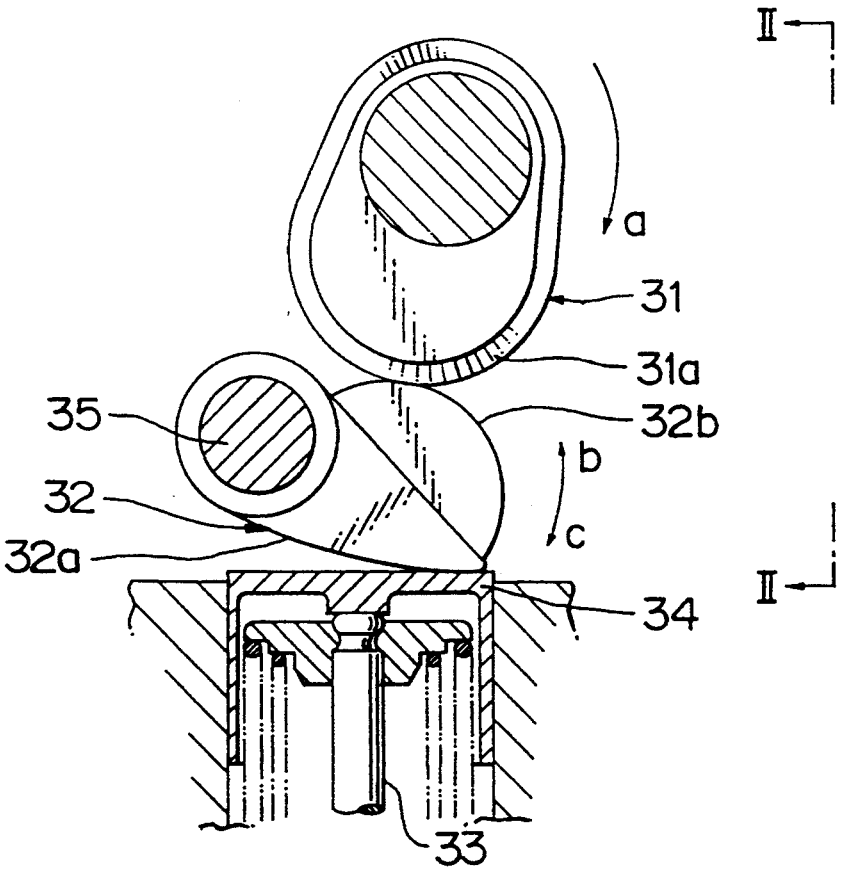
FIG. 1 is a schematic diagram of a valve operating system of an engine for explaining first and second modes in a first embodiment of the present invention and first and second modes in a second embodiment of the present invention.
Figure 2:
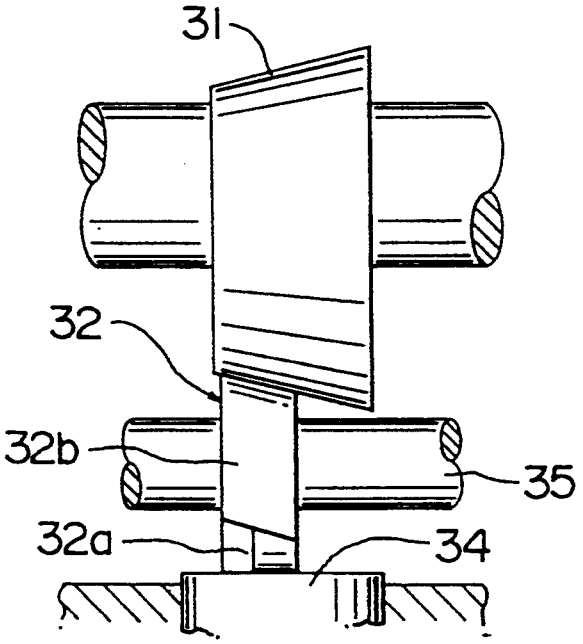
FIG. 2 is a view taken along line II—II in FIG. 1.

The engine valve operating system shown in FIGS. 1 and 2 is provided with an operating cam 31 and a swing cam 32. The operating cam 31 is rotated by the driving force of the engine. The swing cam 32 has a cam surface 32*a* which slidably contacts with a valve tappet 34 disposed on the upper end of the stem of a valve 33 and a circular cam follower 32*b* slidably contacts with the cam surface 31*a* of the operating cam 31, The swing cam 32 is swingably supported by a shaft 35. The swing cam 32 swings in the directions of the arrows b and c while the operating cam 31 rotates in the direction of the arrow a. These motions of the operating cam 31 and the swing cam 32 make the valve 33 open and close.

Figure 3:
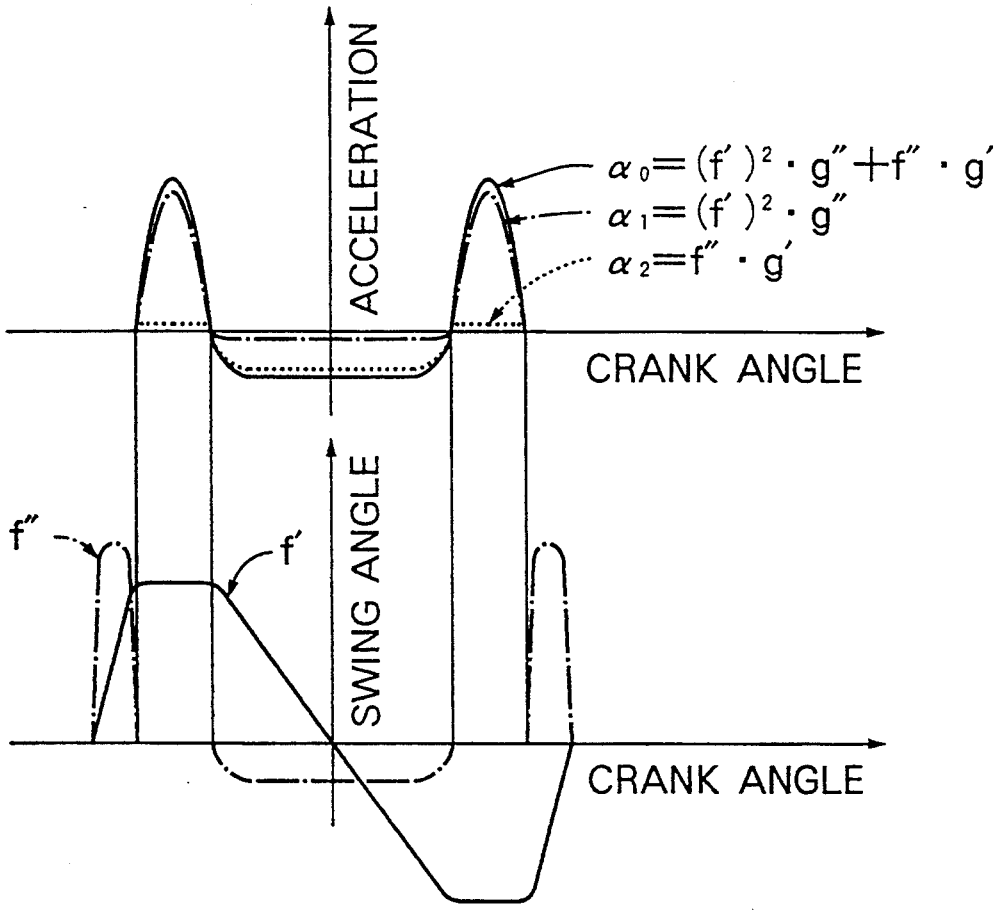
FIG. 3 is a graphical representation showing a cam characteristic in a first mode in the first embodiment of the present invention.
Figure 4:
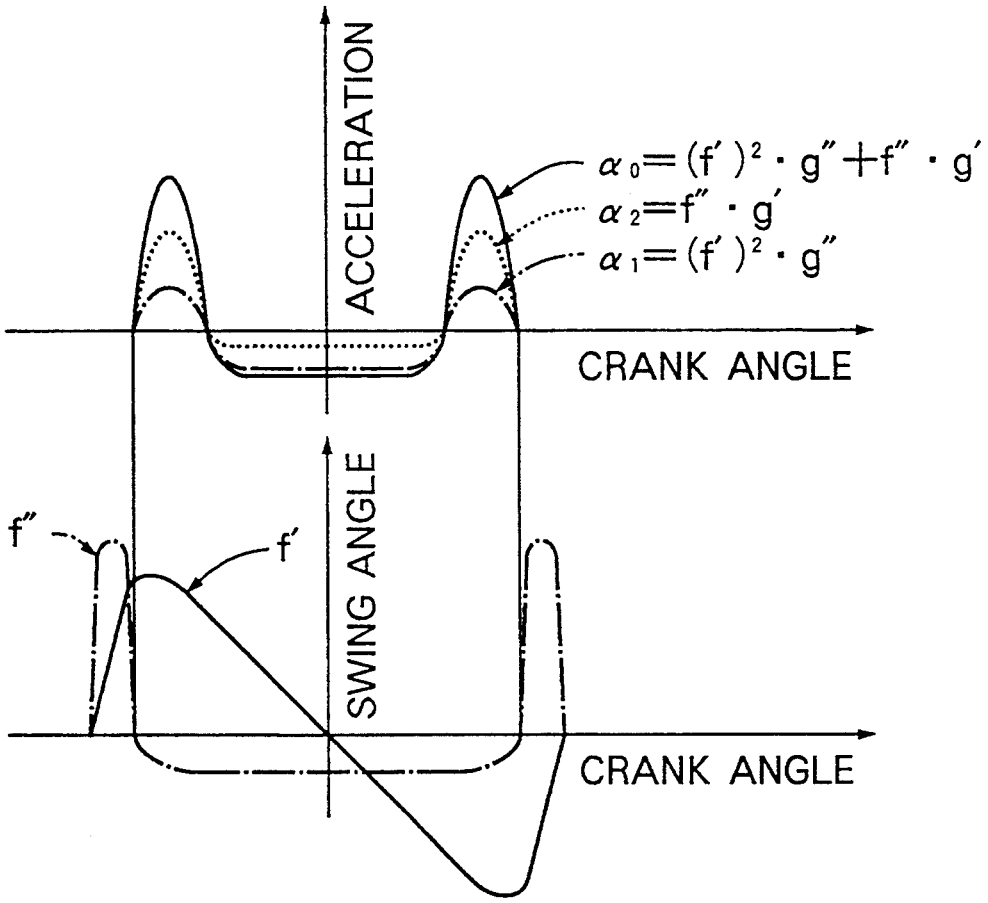
FIG. 4 is a graphical representation showing a cam characteristic in a second mode in the first embodiment of the present invention.

The acceleration characteristics of the valve 33 during a valve lifting operation are shown at the top of FIGS. 3 and 4. FIGS. 3 and 4 relate to different modes, as explained later. The solid curved line ($\alpha_0$) shown in FIGS. 3 and 4 represent the acceleration characteristics of the valve 33. Each has positive acceleration regions at the opposite ends thereof and a negative acceleration region between the two positive acceleration regions. The acceleration ($\alpha_0$) is the sum of the acceleration component ($\alpha_1$) of the swing cam 32 and the acceleration component ($\alpha_2$) of the operating cam 31. Specifically, the acceleration components ($\alpha_1$) and ($\alpha_2$) of the cams 32 and 31 are expressed as follows:

$$\alpha_1=(f')^2*g''$$

$$\alpha_2=f''*g'$$

and the composite acceleration ($\alpha_0$) is expressed as:

$$\alpha_0=f''*g'+(f')^2*g''$$

where (g') is the cam speed of the swing cam 32, (g'') is the acceleration of the swing cam 32, (f') is the cam speed of the operating cam 31 and (f'') is the acceleration of the operating cam 31 when (g) is the cam lift of the swing cam 32 and (f) is the cam lift of the operating cam 31.

As can be seen from the above equations, any given acceleration characteristic of the valve lift can be achieved using various combinations of the acceleration component ($\alpha_1$) of the swing cam 32 and the acceleration component ($\alpha_2$) of the operating cam 31.

The inventors established a first mode and second mode to obtain the same composite acceleration ($\alpha_0$) and then studied behavior of the swing cam 32 in these first and second modes. In the first mode, the cam surfaces of the swing cam 32 and the operating cam 31 were formed so that, as shown in FIG. 3, the acceleration component ($\alpha_1$) of the swing cam 32 was greater than the acceleration component ($\alpha_2$) of the operating cam 31 in the positive acceleration region and the acceleration component ($\alpha_2$) of the operating cam 31 was greater than the acceleration component ($\alpha_1$) of the swing cam 32 in the negative acceleration region. In the second mode, the cam surfaces of the swing cam 32 and the operating cam 31 were formed so that, as shown in FIG. 4, the acceleration component ($\alpha_2$) of the operating cam 31 was greater than the acceleration component ($\alpha_1$) of the swing cam 32 in the positive acceleration region and the acceleration component ($\alpha_1$) of the swing cam 32 was greater than the acceleration component ($\alpha_2$) of the operating cam 31 in the negative acceleration region.

Figure 5:
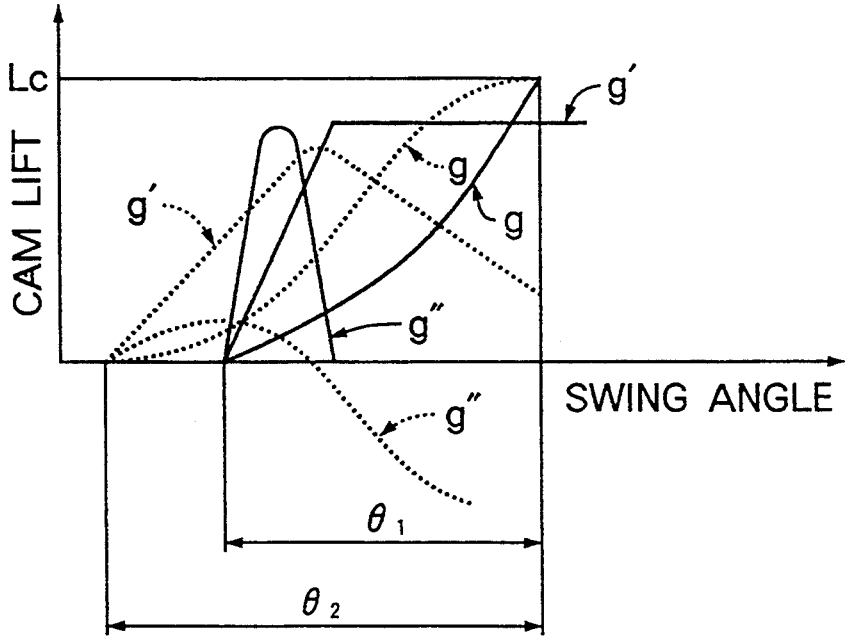
FIG. 5 is a graphical representation showing a cam lift characteristic as a function of a swing angle in the first embodiment of the present invention.

The first mode will be explained with reference to FIGS. 3 and 5. Referring to FIG. 3, the operating cam 31 has the speed characteristic (f') indicated at the bottom of FIG. 3 by a solid line and the acceleration characteristic (f'') indicated by a chain line also at the bottom in FIG. 3. These characteristics are necessary to obtain the acceleration component ($\alpha_1$) of the swing cam 32 and the acceleration component ($\alpha_2$) of the operating cam 31. Further, the acceleration characteristic (g'') shown by the solid line (g'') in FIG. 5 is that necessary to obtain the acceleration component ($\alpha_1$) of the swing cam 32 and the acceleration component ($\alpha_2$) of the operating cam 31 by employing the speed characteristic (f') and the acceleration characteristic (f'') of the operating cam 31. The acceleration characteristic (g') is integrated to obtain the speed characteristic (g') shown by the solid line (g') in FIG. 5 and, further, the speed characteristic (g') is integrated to obtained the cam lift characteristic (g) of the swing cam 32 as a function of the swing angle thereof, as shown by the solid line (g) in FIG. 5.

Next, the second mode will be explained with reference to FIGS. 4 and 5. Referring to FIG. 4, the speed characteristic (f') and the acceleration characteristic (f'') of the operating cam 31 respectively shown by the solid line and the chain line at the bottom of FIG. 4 are those necessary to obtain the acceleration component ($\alpha_1$) of the swing cam 32 and the acceleration component ($\alpha_2$) of the operating cam 31. Further, the acceleration characteristic (g'') shown by the dashed line (g'') in FIG. 5 is that necessary to obtain the acceleration component ($\alpha_1$) of the swing cam 32 and the acceleration component ($\alpha_2$) of the operating cam 31 by employing the speed characteristic (f') and the acceleration characteristic (f'') of the operating cam 31. The acceleration characteristic (g'') is integrated to obtain the speed characteristic (g') shown by the dashed line (g') in FIG. 5 and, further the speed characteristic (g') is integrated to obtain the cam lift characteristic (g) of the swing cam 32 as a function of the swing angle thereof as shown by the dashed line (g) in FIG. 5.

Referring to FIG. 5, a comparison of the cam lift characteristic (g) in the first mode (shown by the solid line) with the cam lift characteristic (g) in the second mode (shown by the dashed line) shows that swing angles of the swing cam 32 necessary to obtain the same cam lift ($L_c$) are $\theta_1$ in the first mode and $\theta_2$ in the second mode, where $\theta_2$ is greater than $\theta_1$. It can therefore be concluded that the first mode can obtain the same cam lift as the second mode with a swing cam 32 having a smaller swing angle.

Next, the first embodiment of the present invention based on the above-mentioned considerations will be described with reference to FIGS. 6 and 7.

Figure 6:
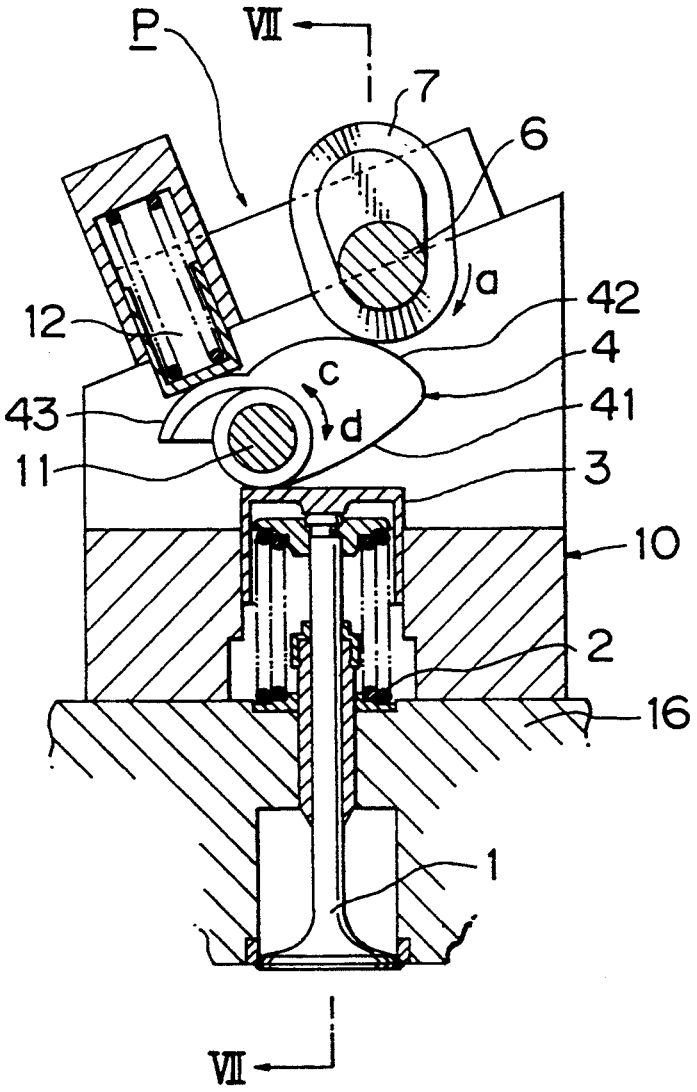
FIG. 6 is a schematic diagram of a valve operating system of an engine according to the first and second embodiments of the present invention.
Figure 7:
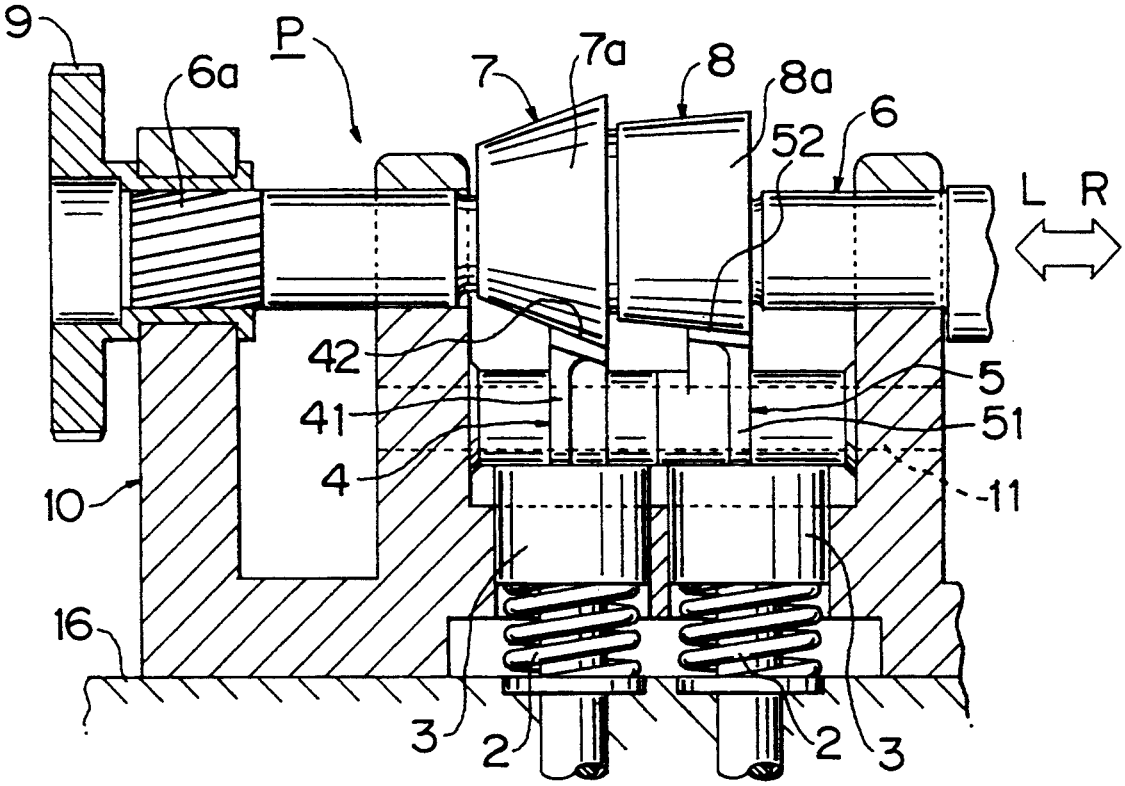
FIG. 7 is a cross-sectional view taken along line VII—VII of FIG. 6.

Referring to FIGS. 6 and 7, a multi-cylinder engine is provided with a valve operating system for operating two intake valves in each cylinder. Only one of the two valves 1 is shown in FIG. 6. The valves 1 are normally biassed in the closing direction by springs 2, and are provided with valve tappets 3 at the upper ends thereof. The valve tappets 3 are slidably supported by a bracket 10 disposed on a cylinder head 16. The valves 1 are opened and closed by a cam operating mechanism P.

The cam operating mechanism P includes a first operating cam 7 and a second operating cam 8, both of which have tapered cam surfaces in each cylinder and are disposed adjacently in the axial direction, and a camshaft 6 disposed slidably in the axial direction. The camshaft 6 is provided with at one end 6a thereof which with a helical spline and is rotatably supported by a bracket 10. The one end 6a of the camshaft 6 is further connected through the spline with a cam gear 9. The other end (not shown) of the camshaft 6 is connected with a motor (not shown) for moving the cam shaft 6 in the directions shown by the arrows R and L in FIG. 7. The camshaft 6 is moved within a predetermined stroke in the axial direction by the motor.

A swing cam supporting shaft 11 is provided parallel to the camshaft 6 and between the camshaft 6 and the valve tappets 3 of the valves 1. The swing cam supporting shaft 11 is provided with a first swing cam 4 and a second swing cam 5. The first and second cams 4 and 5 are in sliding contact with the respective operating cams 7 and 8 and the respective valve tappets 3 of the valves 1. The swing cams 4 and 5 include cam surfaces 41 and 45 which are in sliding contact with the top surfaces of the valve tappets 3, tapered cam followers 42 and 52 which are in sliding contact with cam surfaces 7a and 8a of the operating cams 7 and 8, and spring receiving surfaces 43 and 53 which are in sliding contact with a swing cam biasing device 12 constantly biasing the cam followers 42 and 52 onto the operating cams 7 and 8 with predetermined pressure. The swing cams 4 and 5 follow the rotation of the operating cams 7 and 8 in the direction designated by the arrow a and thus open and close the valves 1 by swinging in the directions designated by the arrows c and d.

The cam operating mechanism P is arranged so that the axial positional relationship between of the operating cams 7 and 8 and the swing cams 4 and 5 can be changed in the axial direction by the motor for moving the camshaft 6 in the axial direction and, whereby the valve lifts and valve opening angles can be changed. Specifically, large valve lifts and large opening angles are obtained when the swing cams 4 and 5 contact with the large diameter sides of the operating cams 7 and 8, as shown in FIG. 7. On the other hand, when the camshaft 6 is moved in the direction of by the arrow R and the swing cams 4 and 5 come in contact with the small diameter sides of the respective operating cams 7 and 8, small valve lifts and small opening angles are obtained. At the same time, the rotation phase between the cam gear 9 and the camshaft 6, namely the valve timing, is changed. Specifically, the valve timing is advanced when the valve lifts are changed to the large valve lift side, and the valve timing is retarded when the valve lifts are changed to the small valve lift side.

Based on the above-mentioned considerations in the embodiment of the present invention, the cam surfaces 7a and 8a of the operating cams 7 and 8 and the cam surfaces 41 and 51 of the swing cams 4 and 5 are formed so that the acceleration components of the swing cams 4 and 5 are greater than those of the operating cams 7 and 8 in the positive acceleration region of the valve lift acceleration characteristic and the acceleration components of the operating cams 7 and 8 are greater than those of the swing cams 4 and 5 in the negative acceleration region of the valve lift acceleration characteristic.

The maximum valve lift of the valves 1 can be obtained by the swing cams 4 and 5 with relatively smaller swing angles, and the cam nose of the associated operating cams 7 and 8 can be shortened in proportion to the amounts of the reduction in the swing angles of the swing cams 4 and 5. As a result, the overall size of the valve operating mechanism or system can be reduced.

A second embodiment of the present invention will now be explained.

Before explaining the second embodiment of the present invention, the considerations which the inventors took into account in developing the second embodiment will be explained with reference to FIGS. 1 and 2. The inventors studied how the acceleration component of an operating cam and the acceleration component of a swing cam mutually influence the acceleration (the composite acceleration) of valve lift before and after a change in valve timing.

The valve timing is changed by moving the operating cam 31 relative to the swing cam 32 in the axial direction.

Similarly to what was stated earlier, the acceleration components ($\alpha_1$) and ($\alpha_2$) of the cams 32 and 31 and the acceleration ($\alpha_0$) of valve lift are expressed as follows:

$$\alpha_1 = (f')^2 * g''$$

$$\alpha_2 = f'' * g'$$

$$\alpha_0 = f'', g, + (f')^2 * g''$$

where (g') is the cam speed of the swing cam 32, (g'') is the acceleration of the swing cam 32, (f') is the cam speed of the operating cam 31 and (f'') is an acceleration of the operating cam 31 when (g) is the cam lift of the swing cram 32 and (f) is the cam lift of the operating cam 31.

As can be seen from the above equations, the valve lift acceleration ($\alpha_0$) is obtained as the sum of the acceleration component ($\alpha_1$) of the swing cam 32 and the acceleration component ($\alpha_2$) of the operating cam 31, from which it will be understood that the valve lift acceleration ($\alpha_0$) can be easily changed by changing the relationship between the accelerations of the swing cam 32 and the operating cam 31.

For realizing the second embodiment of the present invention, the inventors established a first mode and a second mode, and compared composite valve lift acceleration ($\alpha_0$) before and after changing the valve timing in the first and second modes.

Figure 8:
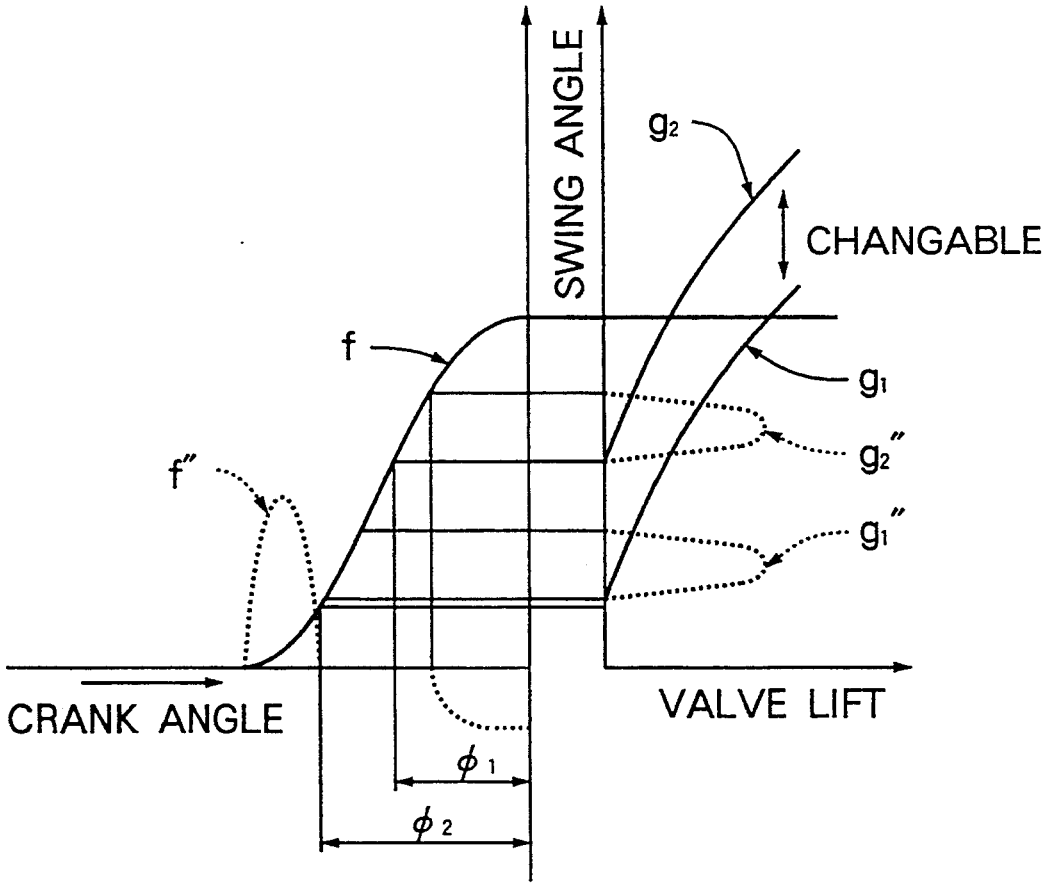
FIG. 8 is a graphical representation showing a cam characteristic in a first mode in the second embodiment of the present invention.

The first mode will be explained with reference to FIGS. 8 and 9. As shown in FIG. 8, in the first mode, the positive acceleration (f'') of the operating cam 31 and the positive acceleration ($g_1''$) of the swing cam 32 at the time of the large valve lift are established so as not to overlap and the positive acceleration (f'') of the operating cam 31 is advanced much more than the positive acceleration ($g_1''$) of the swing cam 32. In FIG. 8, ($g_2''$) is the positive acceleration of the swing cam 32 at the time of a small valve lift, ($g_1$) is the valve characteristic at a large valve lift, ($g_2$) is the valve characteristic at a small valve lift, $\Phi_1$ is the opening angle of the valve 1 at the time of a large valve lift, and $\Phi_2$ is the opening angle of the valve 1 at the time of a small valve lift.

Figure 9:
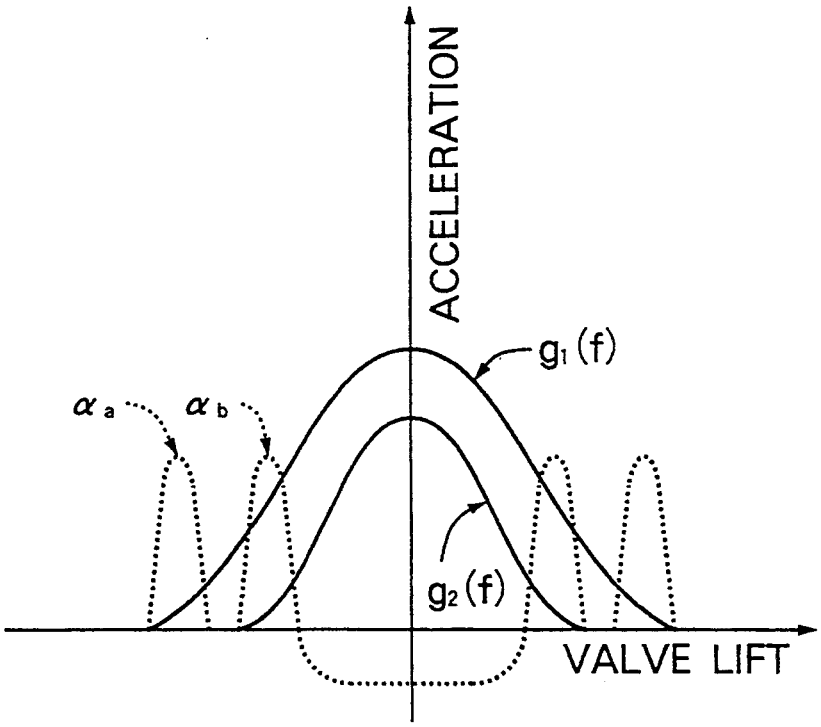
FIG. 9 is a graphical representation showing a composite acceleration at the time of a valve lift operation in the first mode employing the cam characteristic shown in FIG. 8.

FIG. 9 shows the composite accelerations ($\alpha_a$) and ($\alpha_b$) at the time of the valve lift operation in the first mode. In FIG. 9, ($\alpha_a$) is the composite acceleration at the time of a large valve lift before changing the valve timing, and ($\alpha_b$) is the composite acceleration at the time of a small valve lift after changing the valve timing. From the results shown in FIG. 9, it will be understood that the composite accelerations ($\alpha_a$) and ($\alpha_b$) are not substantially changed in size, since the positive acceleration of the operating cam 31 and the accelerations of the swing cam 32 before and after the change of valve timing do not overlap and do not influence each other.

Figure 10:
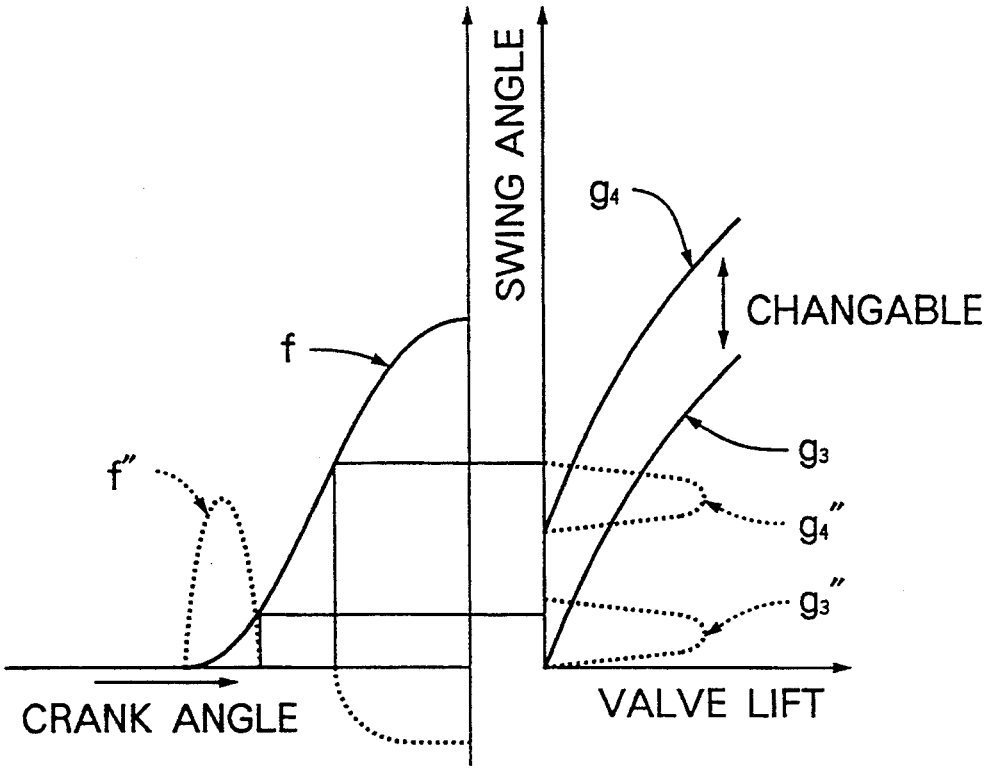
FIG. 10 is a graphical representation showing a cam characteristic in a second mode in the second embodiment of the present invention.

Next, the second mode will be explained with reference to FIGS. 10 and 11. As shown in FIG. 10, in the second mode, the positive acceleration (f'') of the operating cam 31 and the positive acceleration ($g_3''$) of the swing cam 32 at the time of the large valve lift are established so as to overlap. In FIG. 10, ($g_4''$) is the positive acceleration of the swing cam 32 at the time of a small valve lift, ($g_3$) is the valve characteristic at a large valve lift, and ($g_4$) is the valve characteristic at a small valve lift.

Figure 11:
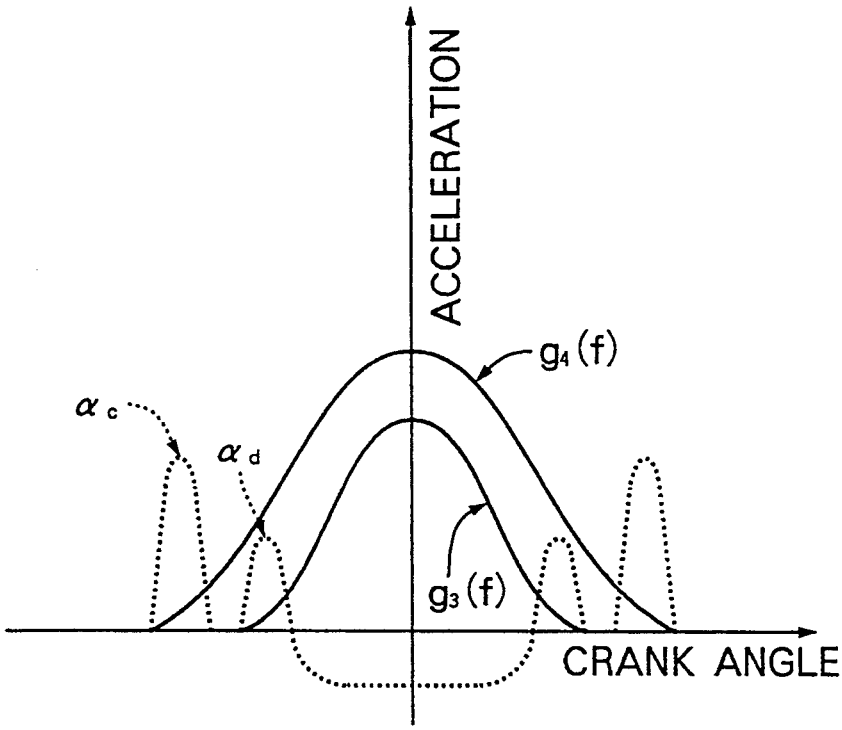
FIG. 11 is a graphical representation showing a composite acceleration at the time of a valve lift operation in the second mode employing the cam characteristic shown in FIG. 10.

FIG. 11 shows the composite accelerations ($\alpha_c$) and ($\alpha_d$) at the time of the valve lift operation in the second mode. In FIG. 11, ($\alpha_c$) is the composite acceleration at the time of a large valve lift before changing the valve timing, and ($\alpha_d$) is the composite acceleration at the time of a small valve lift after changing the valve timing. From the results shown in FIG. 11, it will be understood that the composite acceleration ($\alpha_d$) after changing the valve timing becomes smaller than the composite acceleration ($\alpha_c$) before changing the valve timing since the positive acceleration of the operating cam 31 and the accelerations of the swing cam 32 before and after change of valve timing overlap and influence each other.

Figure 12:
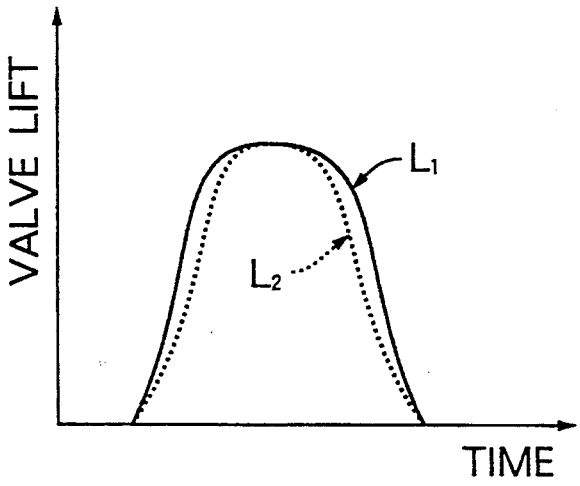
FIG. 12 is a graphical representation showing a cam time period area characteristic in the second embodiment of the present invention.

FIG. 12 shows how the valve lift varies with time in the first and second modes. As shown in FIG. 12, the valve lift curve $L_2$ in the second mode is narrower than the valve lift curve $L_1$ in the first mode. It will therefore be understood that the integrated valve lift time (or crank angle), namely the time period area, is smaller in the second mode than that in the first mode and therefore the engine output in the second mode decreases in proportion to the difference. From this, it will be understood that, for preventing the engine output from decreasing between before and after valve timing change, it is important to provide the cam surfaces of the operating cam 31 and the swing cam 32 so that the valve characteristic of the first mode is obtained.

The second embodiment of the present invention based on the above-mentioned considerations will now be described with reference to FIGS. 6 and 7.

The second embodiment is also applied to the valve operating system of the engine shown in FIGS. 6 and 7. The basic construction of the valve operating system of the second embodiment is the same as that of the first embodiment explained above, except for the differences explained in the following explanation, and, therefore, the explanation thereof will not be repeated here.

Based on the above-mentioned considerations in the second embodiment of the present invention, the cam surfaces of the operating cams 7 and 8 and the cam surfaces of the swing cams 4 and 5 are formed so that the positive acceleration component of the cam surfaces 41 and 51 of the swing cams 4 and 5 and the positive acceleration component of the cam surfaces 7*a* and 8*a* of the operating cams 7 and 8 do not overlap at the time of a valve lift operation, and the positive acceleration components of the operating cams 7 and 8 are advanced much more than the positive acceleration components of the swing cams 4 and 5.

According to the second embodiment of the present invention, since the valve lift acceleration can be prevented from decreasing when the valve timing is changed by the cam shaft 6 being moved in the axial direction, the engine output is not decreased and, the high output capability of the engine output can be maintained.

While the present invention has been illustrated by means of the preferred embodiments, one of ordinary skill in the art will recognize that modifications and improvements can be made while remaining within the spirit and scope of the invention. The scope of the invention is determined solely by the appended claims.

What is claimed is:

1. A valve operating system of an engine for opening and closing a valve, said system comprising:

an operating cam having a cam surface, said operating cam being rotated by the engine; and a swing cam having a cam surface in sliding contact with the valve and a cam follower in sliding contact with the cam surface of the operating cam;

said valve being opened and closed by the swing cam being swung by rotation of the operating cam, said cam surface of the operating cam and said cam surface of the swing cam being formed so that an acceleration component of the swing cam is larger than that of the operating cam in a positive region of a valve lift acceleration defined as a sum of the acceleration component of the operating cam and the acceleration component of the swing cam.

2. A valve operating system according to claim 1, wherein said cam surface of the operating cam and said cam surface of the swing cam are formed so that an acceleration component of the operating cam is larger than that of the swing cam in a negative acceleration region of a valve lift acceleration.

3. A valve operating system according to claim 1, wherein said acceleration components of the swing cam and the operating cam and the valve lift acceleration are defined as:

$$\alpha_1=(f')^2*g''$$

$$\alpha_2=f''*g'$$

$$\alpha_0=f''*g'+(f')^2*g''$$

where $\alpha_1$ is the acceleration component of the swing cam, $\alpha_2$ is the acceleration component of the operating cam, g' is a cam speed of the swing cam, g'' is an acceleration of the swing cam, f' is a cam speed of the operating cam, and f'' is an acceleration of the operating cam.

4. A valve operating system according to claim 1, wherein said system further comprises means for controlling a valve timing by changing a positional relationship between the operating cam and the swing cam in an axial direction, said cam surface of the operating cam and said cam surface of the swing cam being formed so that the valve lift acceleration is not substantially changed between before and after a change in valve timing.

5. A valve operating system according to claim 4, wherein a positive acceleration component of the cam surface of the swing cam and a positive acceleration component of the cam surface of the operating cam do not overlap at the time of a valve lift operation.

6. A valve operating system according to claim 5, wherein said cam surface of the operating cam and said cam surface of the swing cam are formed so that the positive acceleration component of the operating cam is advanced much more than the positive acceleration component of the swing cam.

7. A valve operating system of an engine for opening and closing a valve, said system comprising:

an operating cam having a cam surface, said operating cam being rotated by the engine;

a swing cam having a cam surface in sliding contact with the valve and a cam follower in sliding contact with the cam surface of the operating cam;

said valve being opened and closed by the swing cam being swung by rotation of the operating cam, and means for controlling valve timing by changing a positional relationship between the operating cam and the swing cam in an axial direction;

said cam surface of the operating cam and said cam surface of the swing cam being formed so that a valve lift acceleration defined as a sum of an acceleration component of the operating cam and an acceleration component of the swing cam is not substantially changed between before and after a change in valve timing.

8. A valve operating system according to claim 7, wherein a positive acceleration component of the cam surface of the swing cam and a positive acceleration component of the cam surface of the operating cam do not overlap each other at the time of a valve lift operation.

9. A valve operating system according to claim 8, wherein said cam surface of the operating cam and said cam surface of the swing cam are formed so that the positive acceleration component of the operating cam is advanced much more than the positive acceleration component of the swing cam.

* * * * *